US005700044A

United States Patent [19]

Wartian

[11] Patent Number: 5,700,044

[45] Date of Patent: Dec. 23, 1997

[54] DOOR LATCH OPERATOR

[76] Inventor: George Wartian, 34938 Island View Dr., E., Mt. Clemens, Mich. 48045

[21] Appl. No.: 712,356

[22] Filed: Sep. 11, 1996

[51] Int. Cl.[6] ..... E05B 3/00

[52] U.S. Cl. ..... 292/336.3; 292/165; 292/347

[58] Field of Search ..... 292/336.3, 347, 292/224, 226, 165

[56] References Cited

U.S. PATENT DOCUMENTS

| | | | |
|---|---|---|---|
| 227,587 | 5/1880 | Sargent | 292/336.3 X |
| 1,059,952 | 4/1913 | Spooner | 292/336.3 |
| 2,108,359 | 2/1938 | Accardi | 292/165 X |
| 2,128,550 | 8/1938 | Ford | 292/347 |
| 2,976,072 | 3/1961 | Muttart | 292/336.3 |
| 2,991,107 | 7/1961 | Eichacker et al. | 292/336.3 X |
| 3,200,630 | 8/1965 | Wilson | 292/347 X |
| 3,275,365 | 9/1966 | Wilson | 292/347 |
| 3,283,400 | 11/1966 | Wilson | 292/347 X |
| 3,865,414 | 2/1975 | Schlage | 292/336.3 |
| 5,088,778 | 2/1992 | Lin | 292/336.3 |

*Primary Examiner*—Rodney M. Lindsey

*Attorney, Agent, or Firm*—Barnes, Kisselle, Raisch, Choate, Whittemore & Hulbert, P.C.

[57] ABSTRACT

A door latch operator for retracting a door latch comprises a handle having upper and lower end portions formed with front faces attachable to a door and a vertical hand grip portion between the upper and lower end portions. The upper end portion is in the form of a hollow housing having a chamber therein. The hand grip portion is in the form of a generally U-shaped channel which communicates at one end with the interior of the housing. A lever for operating the door latch is pivoted in the housing and extends into the channel in the hand grip portion to a position where it may be squeezed and rotated from a withdrawn position to a latch retracting position by a hand on the hand grip portion. The handle and the lever are both solid brass forgings.

1 Claim, 1 Drawing Sheet

DOOR LATCH OPERATOR

FIELD OF INVENTION

This invention relates generally to door latches and refers more particularly to a door latch operator.

BACKGROUND AND SUMMARY

In many door latch assemblies, the exposed parts including the handle and operating lever are formed as zinc castings which, for the sake of appearance, are plated with brass. One problem with brass plating, however, is that in a short time it wears away and exposes the base metal.

In accordance with the present invention, the exposed parts of the operating mechanism, including the handle and latch retracting lever, are made entirely of brass and may be used indefinitely without showing any signs of wear. Because a metal mold will not withstand the high temperatures necessary to cast brass, these parts are preferably made as brass forgings.

The handle has upper and lower end portions attachable to a door, and a vertical, channel-shaped hand grip portion between the upper and lower end portions. The upper end portion is in the form of a hollow housing, and a lever for operating the door latch is pivoted in the housing and extends into the channel in the hand grip portion to a position where it may be rotated to a latch retracting position by a hand on the hand grip portion.

A mounting block used to attach the handle to the door is affixed within the housing, and, being concealed therewithin, the mounting block may be made of a less expensive metal such, for example, as zinc.

One object of this invention is to provide a door latch operator having the foregoing features.

Another object is to provide a door latch operator which is composed of a relatively few simple parts, is rugged and durable in use, and is capable of being readily manufactured and easily assembled.

Other objects, features and advantages of the invention will become more apparent as the following description proceeds, especially when considered with the accompanying drawings.

DETAILED DESCRIPTION OF THE PREFERRED EMBODIMENT

Figure 1:
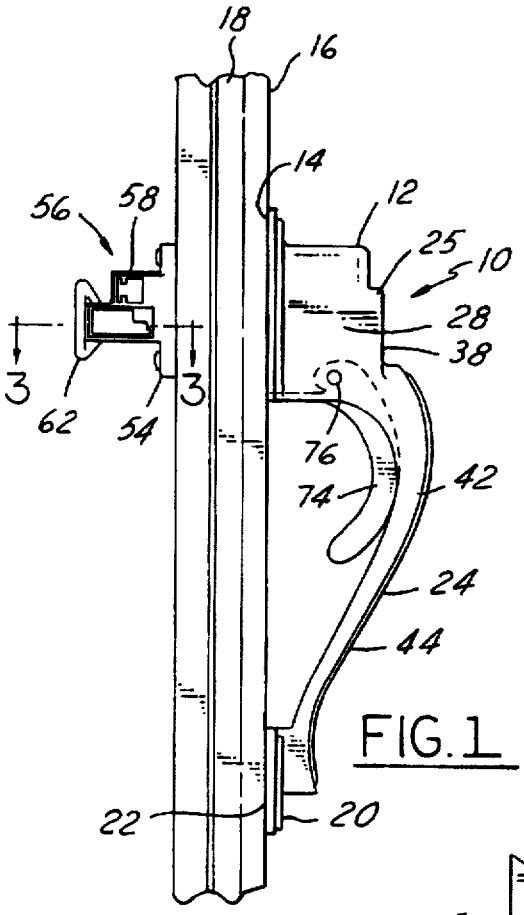
FIG. 1 is a side elevational view of a door latch assembly constructed in accordance with the invention.

Referring now more particularly to the drawings, a handle 10 is shown having an upper end portion 12 formed with a flat front face 14 attached to the outer surface 16 of a door 18, a lower end portion 20 having a flat front face 22 also attached to the outer surface 16 of the door. An elongated vertical hand grip portion 24 between the upper and lower end portions of the handle is provided. The hand grip portion is spaced rearwardly of the upper and lower end portions away from the door. The entire handle is solid brass and preferably is a solid brass forging.

The cross section of the handle from top to bottom is generally U-shaped, with the open side of the U facing the door. The upper end portion 12 of the handle is in the form of a U-shaped housing 25 having laterally spaced-apart parallel side walls 26 and 28. The housing 25 defines a chamber 30 therewithin which is open at the front through the front face where indicated at 32. The bottom wall 34 of the housing has an opening 35 into chamber 30. The housing 25 is closed across the top by a top wall 36 and along the rear by a rear wall 38.

The hand grip portion 24 is U-shaped throughout its length having the laterally spaced-apart side walls 40 and 42 extending in the same plane as and in continuation of the side walls 26 and 28 of the housing. The hand grip portion also has a rear wall 44 connecting the side walls 40 and 42. The hand grip portion thus forms a channel 46 which opens forwardly toward the door and which extends into the chamber 30 of the housing, in effect forming an extension thereof.

Inside the chamber 30 of the housing is a mounting block 48 which is secured in position therein against the rear wall 38 by any suitable means as by adhesive. Extending from the mounting block into the door 18 are vertically spaced horizontal plugs 50 and 51. Threaded fasteners 52 thread into the plugs 50 and 51 to mount the base 54 of the inside latch operator 56 on the inner surface of the door. Thus, both the inside latch operator 56 and the outside handle 10 are secured to the door by the fasteners 52.

Figure 3:
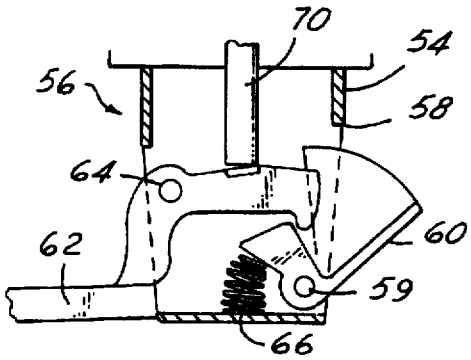
FIG. 3 is a sectional view taken on the line 3—of FIG. 1.

The latch operator 56 on the inside of the door has a housing 58 integral with the base 54. Pivoted to the housing 58 on pin 59 is a latch 60 which may be operated by an inside lever 62 pivoted to the housing on pin 64. Pivoting lever 62 clockwise in FIG. 3 retracts the latch against the action of a compression spring 66.

A horizontal stem 70 extending through the door and engageable with the inside lever 62 may also be used to retract the latch by the outside handle 10 as will now be described.

The stem 70 which extends slidably through the door into the chamber 30 has a head 64 which bears against an integral plate extension 72 of a lever 74. Plate extension 72 has an opening 73 clearing plug 51. The upper end of lever 74 is pivoted in housing 25 by a horizontal pivot pin 76 extending across chamber 30. The lever 74 extends downwardly from the pivot pin 76 into the channel 46. A coil spring 78 encircling stem 70 is compressed between the outer surface of the door and the head 64 of the stem, pressing the head of the stem against the plate extension 72 of the lever and normally holding the plate extension against the mounting block 48 in the retracted position of the lever. When it is desired to release the latch and open the door, the lever 74 is squeezed turning the plate extension 72 of the lever 74 to the dotted line position of FIG. 2 and advancing the stem against the compression of the coil spring 78 to turn the inside lever 62 and retract the latch.

Figure 2:
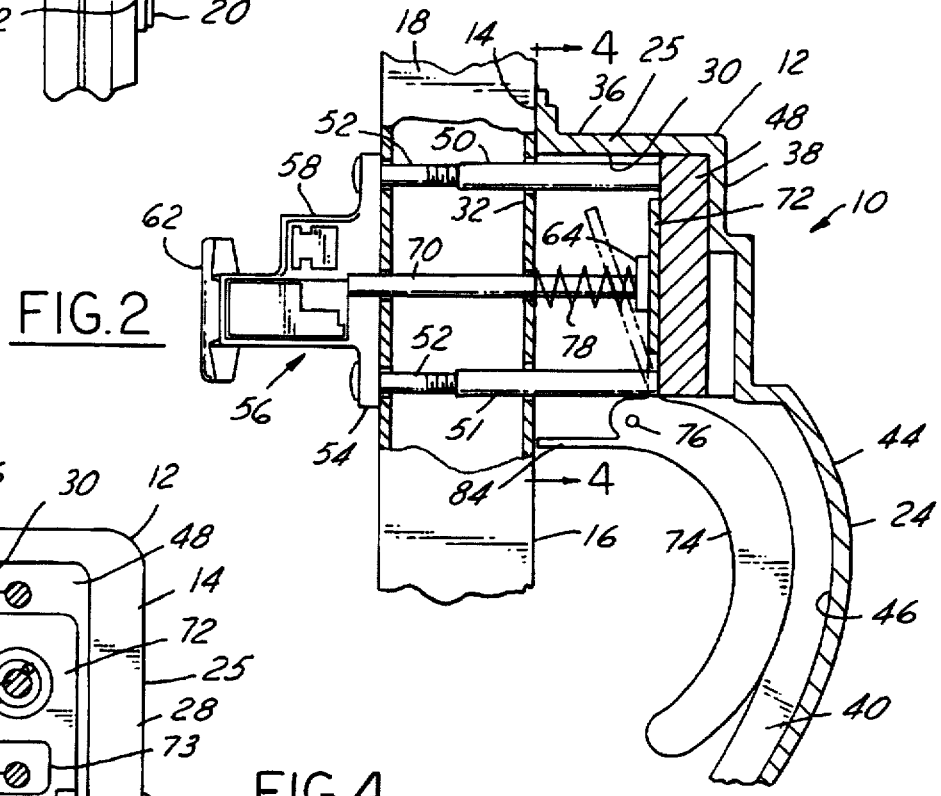
FIG. 2 is an enlarged view of the top portion of the structure shown in FIG. 1, but with parts in section to show the inside of the housing at the top of the handle.

The lever 74 is shown in its retracted position in FIGS. 1 and 2 and when squeezed is withdrawn into the channel of the hand grip portion of the handle.

Figure 4:
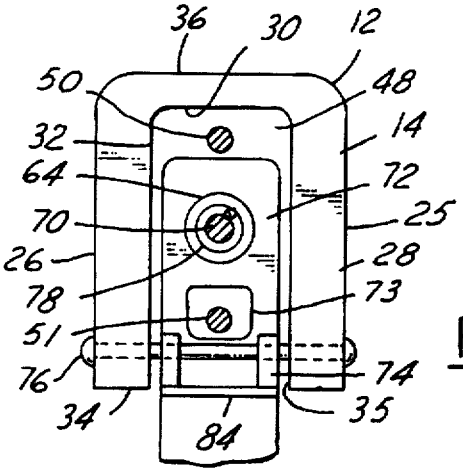
FIG. 4 is a sectional view taken on the line 4—in FIG. 2.

The opening 35 in the bottom wall 34 of housing 25 extends in continuation of the channel in the hand grip portion. The lever 74 has an integral flange 84 which closes the opening 35 in the withdrawn position thereof as shown in FIGS. 2 and 4.

The lever 74, like handle 10, is solid brass and preferably is a solid brass forging.

The mounting block 48 is supported within the chamber of the housing and is completely concealed from view, even at the opening 35 in the bottom wall 34 where the integral flange 84 on the lever 74 closes the opening in the withdrawn position of the lever.

What is claimed is:

1. Door latch operating mechanism for retracting a door latch, comprising:

a solid brass handle having upper and lower end portions formed with front faces attachable to the surface of a door and having a vertical hand grip portion between the upper and lower end portions spaced rearwardly from said front faces and away from the surface of the door, said upper end portion being in the form of a hollow housing having a chamber therein, said hand grip portion being generally U-shaped in cross-section defining an elongated vertical channel which opens forwardly and communicates at one end with said chamber, a solid brass lever adapted to operate said door latch, said lever being pivoted in said housing on a pivot pin extending across said chamber whereby said lever extends downwardly from said pivot pin into said channel in said hand grip portion to a position where it may be squeezed and rotated from a withdrawn position to a latch retracting position by a hand on the hand grip portion, means for securing said housing to the door including a mounting block affixed within said chamber, means for securing the lower end portion of said handle to the door, said housing having a bottom wall and said chamber having an opening through said bottom wall which extends in continuation of said channel, and said lever has an integral flange closing said opening in the withdrawn position thereof, and said mounting block being completely concealed in said housing when said handle is secured to the surface of the door and the lever is in the withdrawn position.

* * * * *